US005216887A

United States Patent [19]

Kadotani et al.

[11] Patent Number: 5,216,887

[45] Date of Patent: Jun. 8, 1993

[54] RADIATIVE-TYPE AIR-CONDITIONING UNIT

[75] Inventors: Kan-ichi Kadotani, Atsugi; Tetsuo Onishi, Hiratsuka, both of Japan

[73] Assignees: Kabushiki Kaisha Komatsu Seisakusho; Kajima Corp., Tokyo, Japan

[21] Appl. No.: 813,052

[22] PCT Filed: Feb. 5, 1988

[86] PCT No.: PCT/JP88/00116

§ 371 Date: Feb. 28, 1990

§ 102(e) Date: Feb. 28, 1990

[87] PCT Pub. No.: WO89/00268

PCT Pub. Date: Jan. 12, 1989

Related U.S. Application Data

[63] Continuation of Ser. No. 686,889, Apr. 17, 1991, which is a continuation of Ser. No. 457,789, Feb. 28, 1990.

[30] Foreign Application Priority Data

Jun. 30, 1987 [JP] Japan ..... 62-160939

[51] Int. Cl.[5] ..... F25B 21/02

[52] U.S. Cl. ..... 62/3.2; 165/49; 454/236; 62/3.62

[58] Field of Search ..... 62/3.2, 3.3, 3.62, 3.7; 165/49; 454/236

[56] References Cited

U.S. PATENT DOCUMENTS 3,282,267 11/1966 Eidus ..... 62/3.2
5,074,116 12/1991 Kadotani et al. ..... 62/3.2

FOREIGN PATENT DOCUMENTS 0034986 9/1981 European Pat. Off. .
1301454 8/1969 Fed. Rep. of Germany .

*Primary Examiner*—John Sollecito
*Attorney, Agent, or Firm*—Armstrong, Westerman, Hattori, McLeland & Naughton

[57] ABSTRACT

A radiative-type air-conditioning unit capable of being freely moved to and set in different positions, and used to deal with the problems concerning the unevenly distributed heat loads in a closed office in which a plurality of office automation (OA) machines are installed. This radiation air-conditioner consists of a radiation endothermic/radiating plate including a radiation generating surface (21) formed on one side surface of a panel (20), a plurality of thermoelectric elements (22) attached to the other side surface of the panel (20), and a plurality of heat exchanger means (25) attached to the other surfaces of these thermoelectric elements (22). Accordingly, noise does not occur in this radiation air-conditioner, and maintenance work therefor is substantially not required. Since this radiation air-conditioner can be installed in a small space owing to its small weight and thickness and compact structure, it is used very extensively.

7 Claims, 8 Drawing Sheets

RADIATIVE-TYPE AIR-CONDITIONING UNIT

This application is a continuation of application Ser. No. 686,889 filed Apr. 17, 1991 which is a continuation division of application Ser. No. 457,789 filed Feb. 28, 1990.

TECHNICAL FIELD OF THE INVENTION

This invention relates to a radiative-type air-conditioning unit adapted for use as an office air conditioner for office automation corner in an enclosed room, an office room and a conference room, etc., and also as an air conditioner for home use.

BACKGROUND OF THE INVENTION

As a conventional radiative type air-conditioning unit, there is known a system whose radiant heat transfer unit is fixedly secured to the ceiling of a room or the side wall surface thereof such that chilled water or hot water, or alternatively cool air or hot air may flow through the radiant heat transfer unit, and the temperature of the unit is controlled thus conducting air-conditioning in the room. In this system, chilled water or hot water, or alternatively, cool air or hot air is supplied through pipings by an air-conditioning unit installed separately.

Further, besides the above-mentioned standing radiative air-conditioning unit, there is a portable air-conditioning unit wherein an air conditioner is accommodated in a movable box-shaped housing, and the housing is formed with a duct adapted to blow off cool air or warm air.

Still further, as a partitioning panel shaped radiative-type air-conditioning unit, there is known a system wherein the partitioning panel is provided with an electric heater or alternatively it is arranged such that a heated or cooled fluid is passed therethrough.

However, out of the above-mentioned conventional radiative-type air-conditioning units, those which require provision of pipings entail piping work and cannot be moved to a suitable plate, and therefore they cannot be used for local air-conditioning.

In recent years, office automation (O.A.) equipment have come into wide use in offices, and if the number of such O.A. equipment used increases, then in most cases the heat developed by them causes a conspicuous deviation in thermal loading in the office room. It is not easy to regulate such a deviation in thermal loading by air-conditioning in the whole room, and particularly it is almost impossible to create an air-conditioning effect suitable for an individual. Further, it is also impossible to modify air-conditioning pipings according to changes in thermal loading conditions in a room due to alteration of office layout.

To settle these problems, it is envisaged to use the above-mentioned portable radiative-type air-conditioning unit suitable for local air-conditioning without the need for piping work, however, this portable type one has the following disadvantages.

Stating in brief, in order to cope with the deviated thermal loading in the office room where many O.A. equipment are located as mentioned above, the number of the portable radiative-type air-conditioning units must be increased, or alternatively, the air-conditioning capacity of each unit must be increased. In both cases, there is a problem in that the sound-generated by a compressor mainly for cooling purposes or a fan accommodated in the box-shaped housing becomes noise to persons near the air-conditioning unit.

SUMMARY OF THE INVENTION

The presnet invention has been made in view of the above-mentioned situation in the prior art and also paying attention to the fact that, to achieve improvements in working environment in offices, comparatively low-partitioning panels having a height of 900 to 1800 mm, which are referred to as so-called "low partition", have come to be used.

Accordingly, an object of the present invention is to provide a radiative-type air-conditioning unit which utilizes "Peltier Effect" provided by thermoelectric elements and is noiseless, and which does not require provision of special piping work and is substantially maintenance free.

Another object of the present invention is to provide a radiative-type air-conditioning unit which has various usages in that it can be used as a ceiling material of a room or a side wall material thereof or it can be used as a portable unit, and which is of light weight, thin and compact.

A further object of the present invention is to provide a radiative-type air-conditioning unit having a high energy utilization efficiency and excellent response and control characteristics resulting from the use of a direct air-conditioning system wherein the temperature sensed by a human body is controlled by the radiant heat transfer surface thereof.

To achieve the above-mentioned objects, according to a first aspect of the present invention, there is provided a radiative panel type air-conditioning unit comprised of a radiation heat absorbing and emitting board; including a radiant heat transfer surface formed on one side surface of a panel; a plurality of thermoelectric elements mounted on the other side surface of the panel; and a plurality of heat exchange means mounted on the opposite side surfaces of these thermoelectric elements.

Further, according to a second aspect of the present invention, there is provided a radiative panel type air-conditioning unit as set forth in the first aspect, wherein the panel is a partitioning panel member which is comprised of a frame, a piece of front panel and a piece of rear panel that are formed on both surfaces of the frame, and the unit further comprises cross-flow fan means installed inside of the panel member; air intakes formed in the portions of the front panel opposite to the cross-flow fans; an opening formed in the uppermost end of the panel member; a window opening formed in the upper half of the panel member and adapted to be fitted with the radiation heat absorbing and emitting board, the radiation heat absorbing and emitting board being mounted in the window opening in such a manner that the radiant heat transfer surface faces the front panel and the heat exchange means are located in the ventilation passage for the cross-flow fan means defined within the panel member; and controller means for controlling the thermoelectric elements of the radiation heat absorbing and emitting board and the cross-flow fan means.

Further, according to the present invention, there is provided a radiative panel type air-conditioning unit as set forth in the second aspect, characterized in that the cross-flow fan means have a vertically aligned positional relationship with each other and comprise a first cross-flow fan located at an upper position and a second cross-flow fan located at a lower position, and said unit further comprises first air intakes formed in the portions of the rear panel opposite to the first cross-flow fan; blowoff ports for the first cross-flow fan which open upwardly inside of the panel member; second air intakes formed in the portions of the front panel opposite to the second cross-flow fan; and blowoff ports for the second cross-flow fan formed in the portions of the front panel opposite to the second cross-flow fan and at a position lower than the second air intake.

The above-mentioned and other advantages, manners and objects of the present invention will become apparent to those skilled in the art by making reference to the following description and the accompanying drawings in which preferred embodiments incorporating the principles of the present invention are shown by way of example only.

DETAILED DESCRIPTION OF PREFERRED EMBODIMENTS

Figure 1:
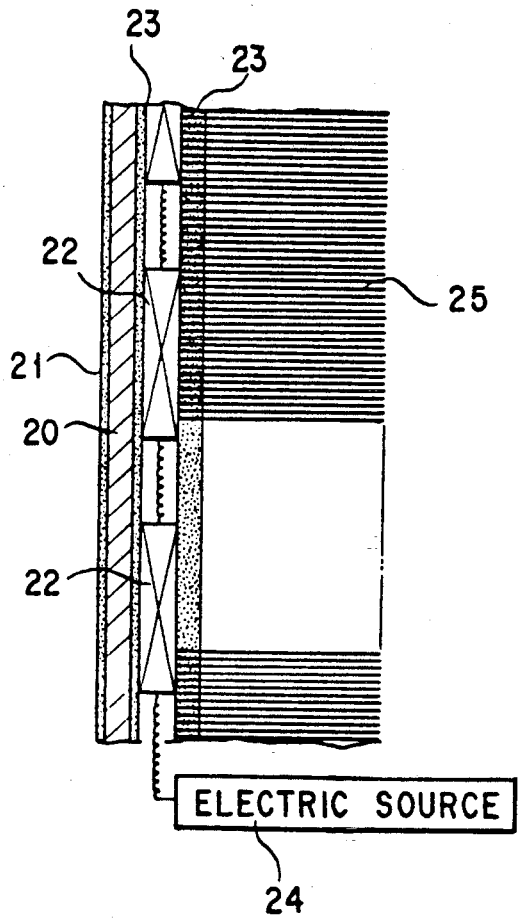
FIG. 1 is a fragmentary, enlarged sectional view showing schematically the configuration of principal parts of one embodiment of the radiative panel type air-conditioning unit according to the present invention.

A first embodiment of a radiative panel type air-conditioning unit according to the present invention will now be described in detail below with reference to FIGS. 1 to 4 in the accompanying drawings.

In the drawings, reference numeral 20 dentoes a radiation panel which serves as the substrate of a radiant heat absorbing and emitting board. The radiation panel 20 has a radiant coating layer 21 such as, for example, a black paint or the like applied onto the front surface thereof, and a plurality of thermoelectric elements 22 bonded onto the whole rear surface thereof by means of an adhesive 23. The arrangement is made such that, when the thermoelectric elements 6 are fed with a d.c. electric current from a power supply 24, heat is absorbed through one side surface thereof, for example, the side of the radiation panel 20 and emitted towards the opposite side thereof by "Peltier Effect". (When air-cooling is made) The above-mentioned effect is reversed when the direction of flow of electric current is reversed. (When heating is made) Further, the above-mentioned thermoelectric elements 22 have a plurality of fine pin fins 25 for heat exchange purposes mounted on the other side thereof by the adhesive 23.

Figure 2:
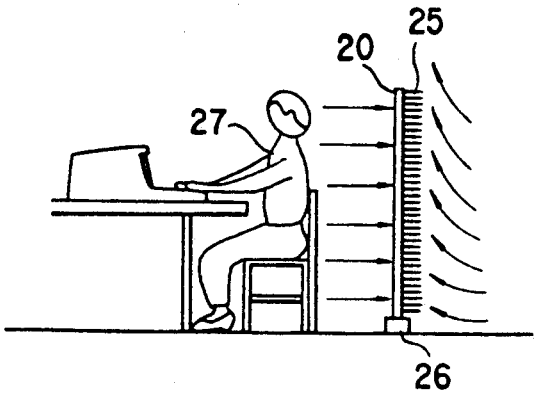
FIGS. 2 to 4 are side elevational views showing schematically conditions wherein the embodiment shown in FIG. 1 is used.

As shown in FIG. 2, the above-mentioned radiation panel 20 is in the form of a movable screen having a base 26 fixed to the lower end thereof and which stands on its own bottom.

In the above-mentioned arrangement, when as shown in FIG. 2 the radiation panel 20 is installed with the radiant heat transfer surface thereof facing an office worker 27, and each of the thermoelectric elements 22 is fed with a d.c. electric current in a direction of absorbing the heat from the side of the radiation panel 20, the radiation heat from the side of the worker 27 is absorbed by the radiant heat transfer surface of the radiation panel 20 so that the side of the worker 27 is cooled. Whilst, when the direction of flow of electric current is changed so as to emit heat from the radiant heat transfer surface, the side of the worker 27 is heated by the heat emitted by the above-mentioned radiant heat transfer surface.

On the rear side of the radiation panel 20, the heat emitted from or absorbed by the opposite side of the above-mentioned thermoelectric elements 22 is subjected to natural convection for heat exchange.

Whilst heat is emitted from or absorbed by the radiant heat transfer surface of the above-mentioned radiation panel 20 mainly by radiation, heat emission or absorption can of course be made even by natural convection and heat conduction.

Figure 3:
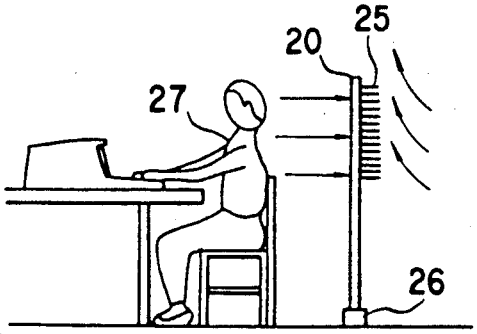

Further, whilst the embodiment illustrated in FIG. 2 shows a condition wherein the radiation panel 20 is installed behind the worker, the radiation panel 20 may be installed alternatively on the side or in front of the worker 27 wiht the radiant heat transfer surface thereof facing the worker 27. Fruther, in the embodiment shown in FIG. 2 shows the case where the whole of one side surface of the radiation panel 20 serves as the radiant heat transfer surface, however, the arrangement may be made such that a portion of the radiation panel 20 may serve as the radiant heat transfer surface as shown in FIG. 3.

Figure 4:
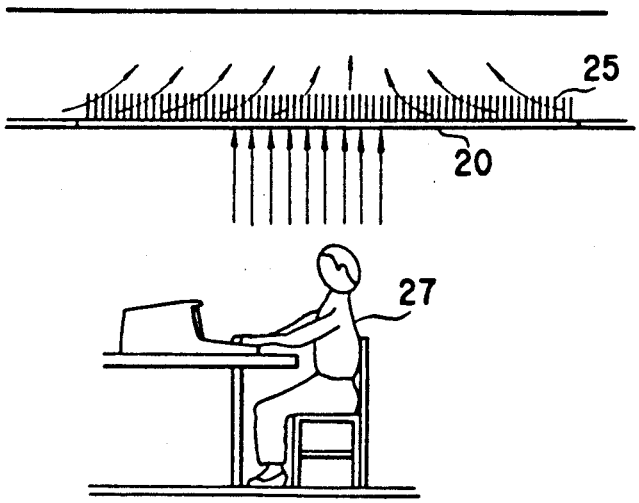

Still further, as shown in FIG. 4, the above-mentioned radiation panel 20 may be installed above the office worker 27; that is; it may be attached to the ceiling located above.

Furthermore, whilst the above-mentioned embodiment shows the arrangement that the radiation panel 20 has a plurality of thermoelectric elements 20 adhesively bonded onto the rear surface thereof so that radiation heat can be emitted or absorbed through the surface of the radiation panel 20, it is also possible to allow the radiation panel 20 to fulfill radiation heat emitting or absorbing function as well as sound absorbing function.

Figure 5:
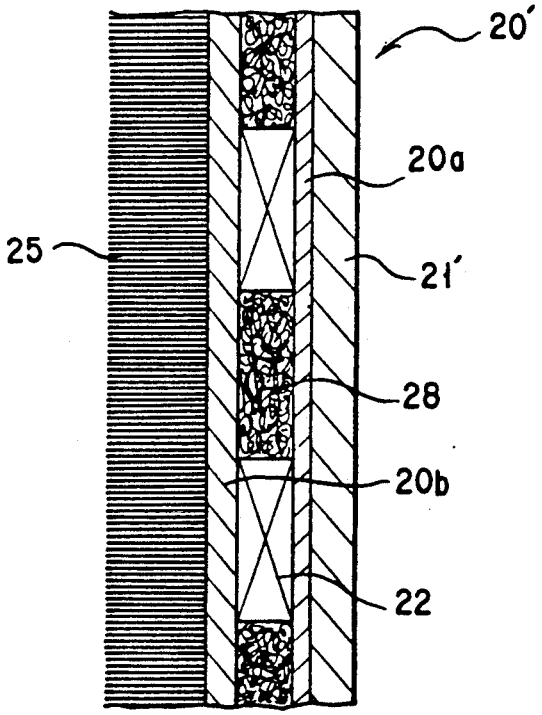
FIG. 5 is a fragmentary, enlarged sectional view showing schematically the configuration of principal parts of a variant of the embodiment shown in FIG. 1.

A variant embodiment of the radiation panel having in combination the heat emitting or absorbing function and the sound absorbing function is shown in FIG. 5.

Reference numeral **20*a* denotes a substrate of a radiation panel 20' which has a material with excellent thermal conductivity and sound absorbing characteristics such as, for example, a metallic heat and sound absorbing material 21' produced by sintering aluminium powder, adhesively bonded onto the surface thereof. The substrate 20*a* has a plurality of thermoelectric elements 22 adhesively bonded onto the rear surface thereof. The thermoelectric elements 22 have a substrate 20*b* adhesively bonded onto the other side surface thereof and to which a plurality of heat exchange fins 25 are attached. Reference nuemral 28 denotes a material having thermal insulating and sound absorbing properties such as, for example, glass wool which is inserted between the thermoelectric elements 22**.

The use of the radiation panel 20' thus condigured enables sound absorbing effect to be achieved in addition to heat absorbing effect thus making it possible to lower the noise level in an office.

In the next place, a second embodiment of the present invention will be described with reference to FIGS. 6 to 11.

Figure 6:
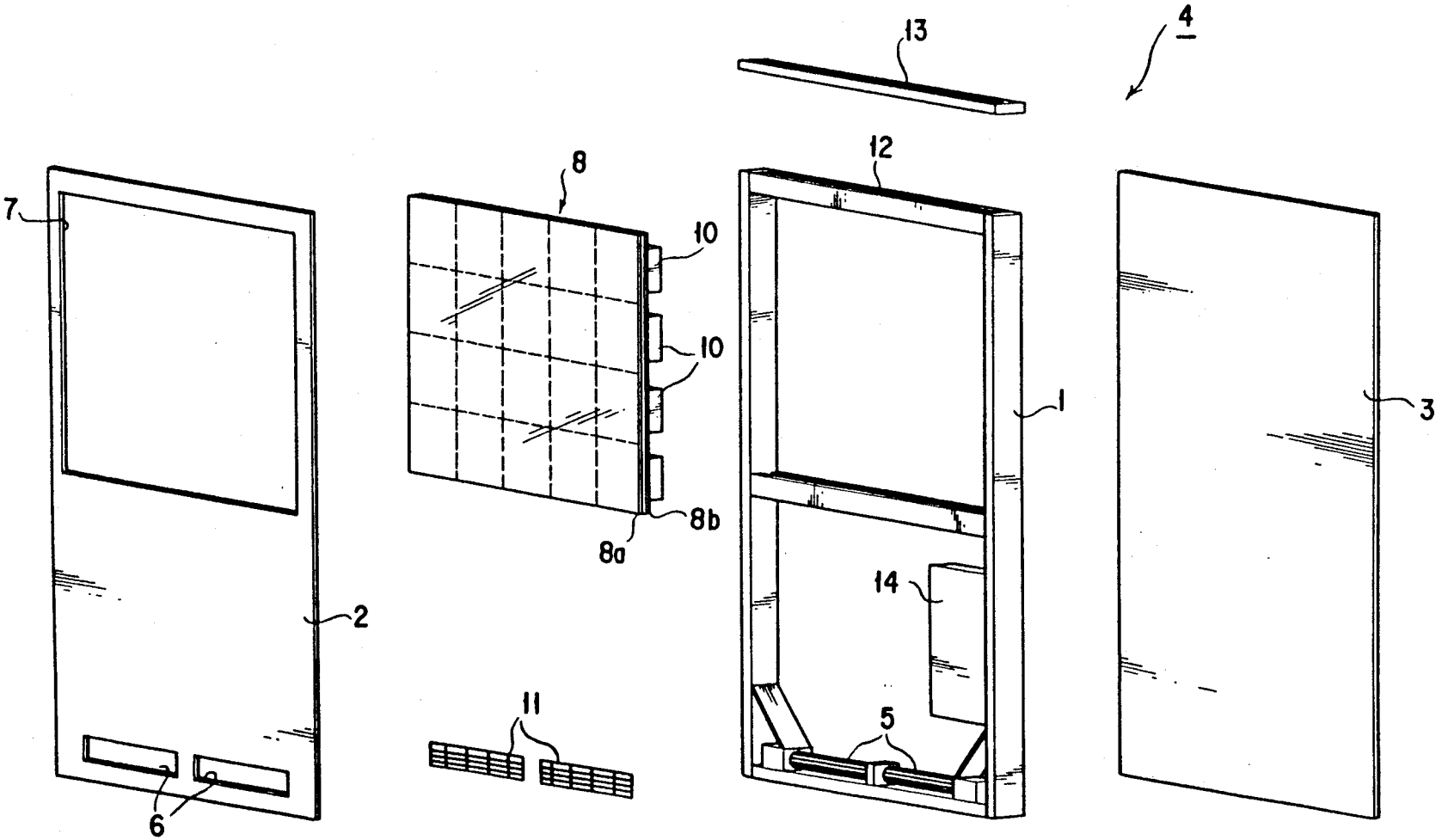
FIG. 6 is a schematic, exploded perspective view showing components of another embodiment of the radiative panel type air-conditioning unit according to the present invention.
Figure 8:
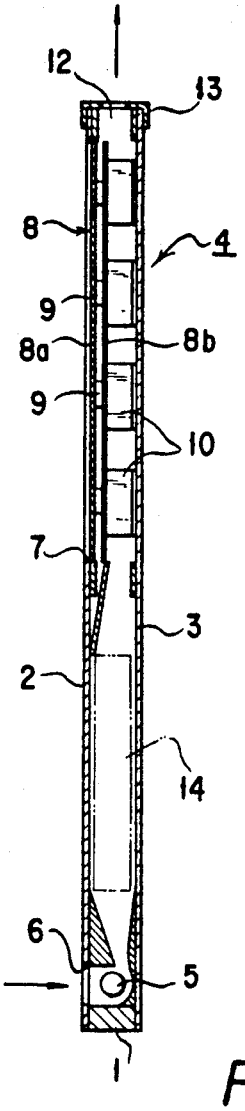
FIGS. 7 and 8 are an assembled perspective view and a schematic longitudinal sectional view, respectively of the embodiment shown in FIG. 6.
Figure 7:
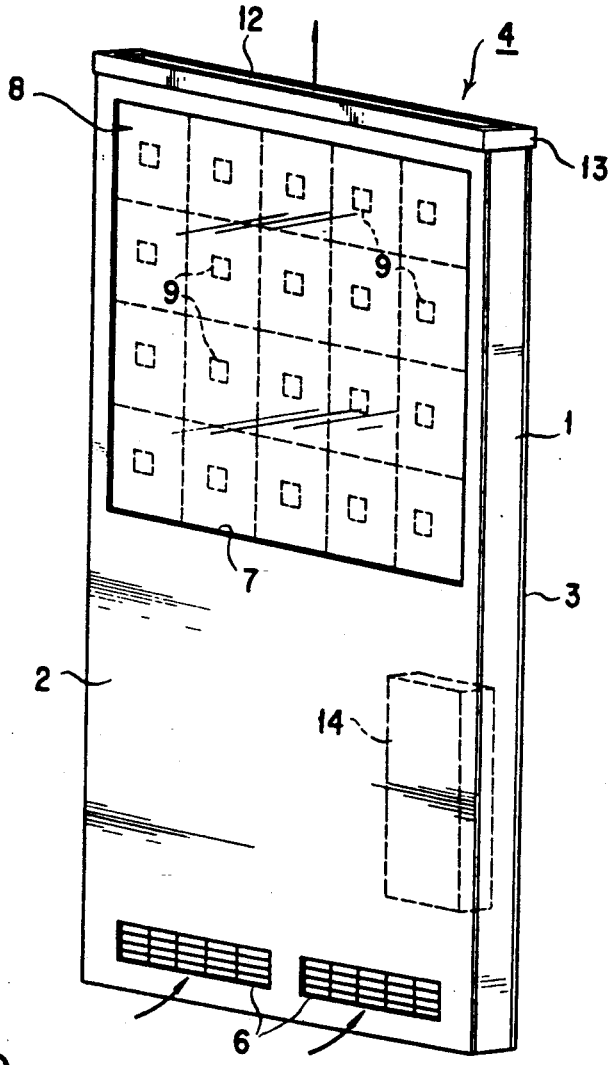

FIG. 6 is an exploded perspective view showing a partitioning panel member, in disassembled condition, for use in a radiative type air-conditioner according to the present invention, and FIGS. 7 and 8 are a perspective view and a schematic, longitudinal sectional view, respectively, of the assembly of the second embodiment. In these drawings, reference numeral 1 denotes a frame or framework shown with the uppermost end kept open. A front panel 2 and a rear panel 3 are fixedly secured to the front and rear surfaces, respectively, of the frame 1 to form a hollow partitioning panel 4 with an open top end. This frame 1 has a cross-flow fan 5 mounted on the lower part thereof. And, the front panel 2 has air inlets 6 formed in the lower part thereof at positions opposite to the cross-flow fan 5. This front panel 2 has a window opening 7 having a large area formed in the upper half thereof. Reference numeral 8 denotes a radiation heat absorbing and emitting board adapted to be fitted in the opening 7 from inside thereof. This radiation heat absorbing and emitting board 8 is made up of two pieces of panels **8*a* and 8*b* having a plurality of thermoelectric elements 9 mounted lengthwise and breadthwise in a regular manner between them. Moreover, the rear panel 8*b* has radiating fins 10 mounted on the outer surface thereof at positions opposite to the thermoelectric elements 9. Further, the thickness of the radiation heat absorbing and emitting board 8 including the radiating fins or heat emitting or absorbing fins 10 is slightly less than that of the frame 1 so that they can be accommodated in the inner space of the partitioning panel 4. Moreover, the radiating fins 10 are adapted to conduct heat exchange with the air flow flowing vertically through the interior of the partitioning panel member 4**, and the vertilating air passage extends vertically therein.

Filters 11 are mounted inside of the air inlets 6 in the panel 2, and an upper cover 13 is fitted fixedly in an upper opening 12 formed in the upper end of the partitioning panel member 4.

Further, in the drawings, reference numeral 14 denotes a controller fixedly secured to the frame 1 in the air flow passage formed inside of the partitioning panel member 4. This controller 14 is adapted to control the turning on and off of the cross-flow fans 5, the turning on and off of electricity to the thermoelectric elements 9, the direction of electric current flow through the thermo-electric elements 9 and the intensity of the electric current.

The above-mentioned partitioning panel member 4 is 60 to 80 mm thick and is of a size which is nearly the same as that of an ordinary low partitions, and as occasion demands a plurality of such panel members 4 may be used by placing them laterally in a row.

In the above-mentioned arrangement, when the controller 14 is operated to feed an electric current to the thermoelectric elements 9 so that the front side of the radiation heat absorbing and emitting board 8 is cooled and the heat is emitted through the rear side thereof by "Peltier Effect", and the cross-flow fan 5 is driven, heat is absorbed through the radiation heat absorbing and emitting board 8 whose surface area is defined by the aperture 7 in the front panel 2 of the partitioning member 4 so that the front or outer side of the partitioning member 4 is cooled.

Whilst, at that time, the heat emitted towards the rear side of the radiation heat absorbing and emitting board 8 is transferred to the air flow which is delivered by the cross-flow fan 5, passes through the radiating fins 10 and exhaust from the upper opening 12. At that time, the controller 14 is also cooled by the wind flowing through the interior of the above-mentioned partitioning panel member 4.

Figure 9:
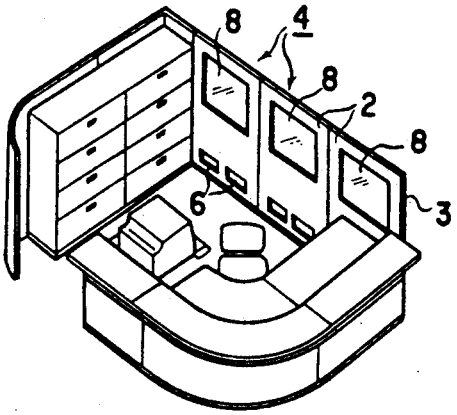
FIG. 9 is a schematic, perspective view showing an example using the embodiment shown in FIG. 6.

FIG. 9 shows an example wherein the above-mentioned partitioning members 4 are used. Each of the partitioning members 4 is located with the front panel 2 thereof facing the interior at intervals of 0.5 to 1.0 meter away from an worker. The controller 14 is controlled in such a manner that the temperature of the front surfaces of the radiation heat absorbing and emitting boards 8 may be kept at 10° to 15° when the room temperature is 23° to 28° C. As a result, a heat transfer by radiation is generated between the operator and the partitioning members 4 so that the operator is subjected to a cooling effect.

Figure 10:
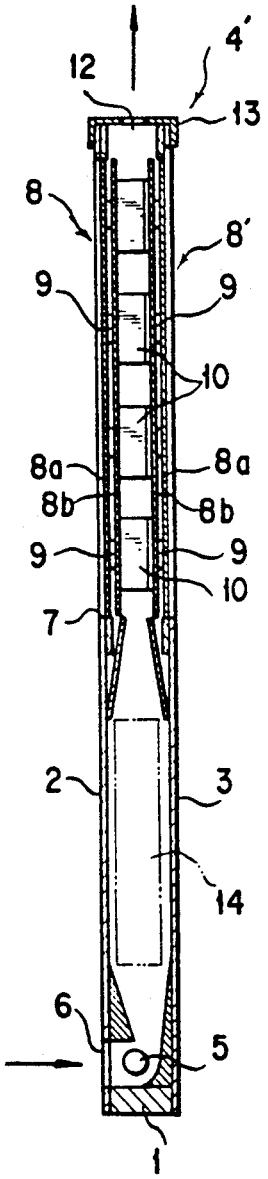
FIGS. 10 and 11 are a schematic, longitudinal sectional view and a schematic, perspective view, respectively, showing two variant examples of the embodiment shown in FIG. 11.

Although the above-mentioned second embodiment shows a single-side type one wherein the radiation heat absorbing and emitting board 8 is located only on one side of the panel member 4, a both-side type one as shown in FIG. 10 may be used instead.

Stating in brief, the latter type one is comprised of a pair of heat absorbing and emitting boards 8 and 8', each consisting of two pieces of panels **8*a* and 8*b* having thermoelectric elements 9 sandwiched between them, the boards 8 and 8' having radiating fins 10 mounted between them and being adapted to be fitted in apertures 7 formed in both sides of a partitioning panel member 4'**.

According to this arrangement, both sides of the partitioning panel member 4' are cooled or heated.

Further, in each of the above-metnioned embodiments, the surfaces of the radiation heat absorbing and emitting boards 8 and 8' are cooled or heated by radiation by changing the direction of flow of electric current through the thermoelectric elements 9.

Further, if the direction of flow of electric current through some of the thermoelectric elements 9 on each of the radiation surfaces of the radiation heat absorbing and emitting boards 8 and 8' is selectively changed, then the radiant air-conditioning function on the radiation surfaces can be controlled. Further, this air-conditioning functional control may be conducted by controlling the intensity of the electric current flow through the thermoelectric elements 9.

Furthermore, it is possible to allow the upper portions of the radiation heat absorbing and emitting boards 8 and 8' to fulfil their cooling function and the lower portions thereof to fulfil their heating function by selectively changing the direction of the electric current flow through the thermoelectric elements 9 by group.

Therefore, by increasing the vertical dimension of the radiation heat absorbing and emitting boards 8 and 8' to increase their areas and making controls so that they can fulfil the above-mentioned functions, the upper half of worker's body can be cooled, and the lower half thereof can be heated so that an ideal working environment wherein he may feel refreshed at his head and get warm at his legs.

Figure 11:
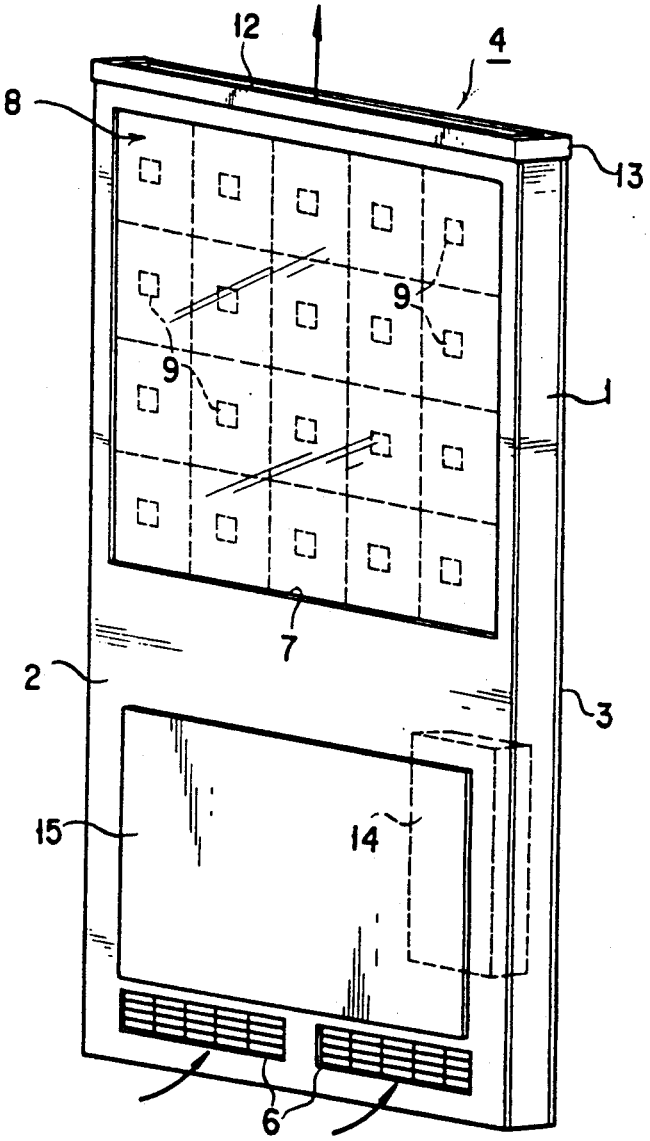

As a means for obtaining the above-mentioned air-conditioning effect, a panel heater 15 may be mounted on the lower part of the partitioning panel member 4 as shown in FIG. 11. the arrangement is made such that the switching on and off of this panel heater 15 and the temperature thereof can be controlled by the controller 14 which controls the thermoelectric elements 9 and the cross-flow fan 5 at the same time.

Further, as another means for attaining the above-mentioned comfortable condition wherein the worker may feel refreshed at his head and get warm at his legs, it is possible to reverse the direction of flow of the wind delivered by the cross-flow fan 5 so as to allow warm air resulting from the heat-exchange by the radiation heat absorbing and emitting surfaces 8 and 8' to be sent into the office room from the air inlets 6 formed in the lower part of the partitioning panel member 4 or 4'. In this case, an electric heater may be installed upstream of the cross-flow fan 5.

Moreover, in the second embodiment shown in FIGS. 6, 7 and 8 and the two variant embodiments shown in FIGS. 10 and 11, although the controller 14 is fixedly secured to the frame 1 in the air current passage defined inside of the partitioning panel member 4, it may be mounted on a member or article other than the air-conditioning panel; in other words; it may be located outside the panel.

In these drawings, the cross-flow fan 5 is shown installed near the lowermost part of the air-conditioning panel, however, it may be installed just below the radiation heat absorbing and emitting board 8.

Subsequently, a third embodiment of the radiant panel air-conditioner according to the present invention will be described with reference to FIGS. 12 and 13.

Figure 12:
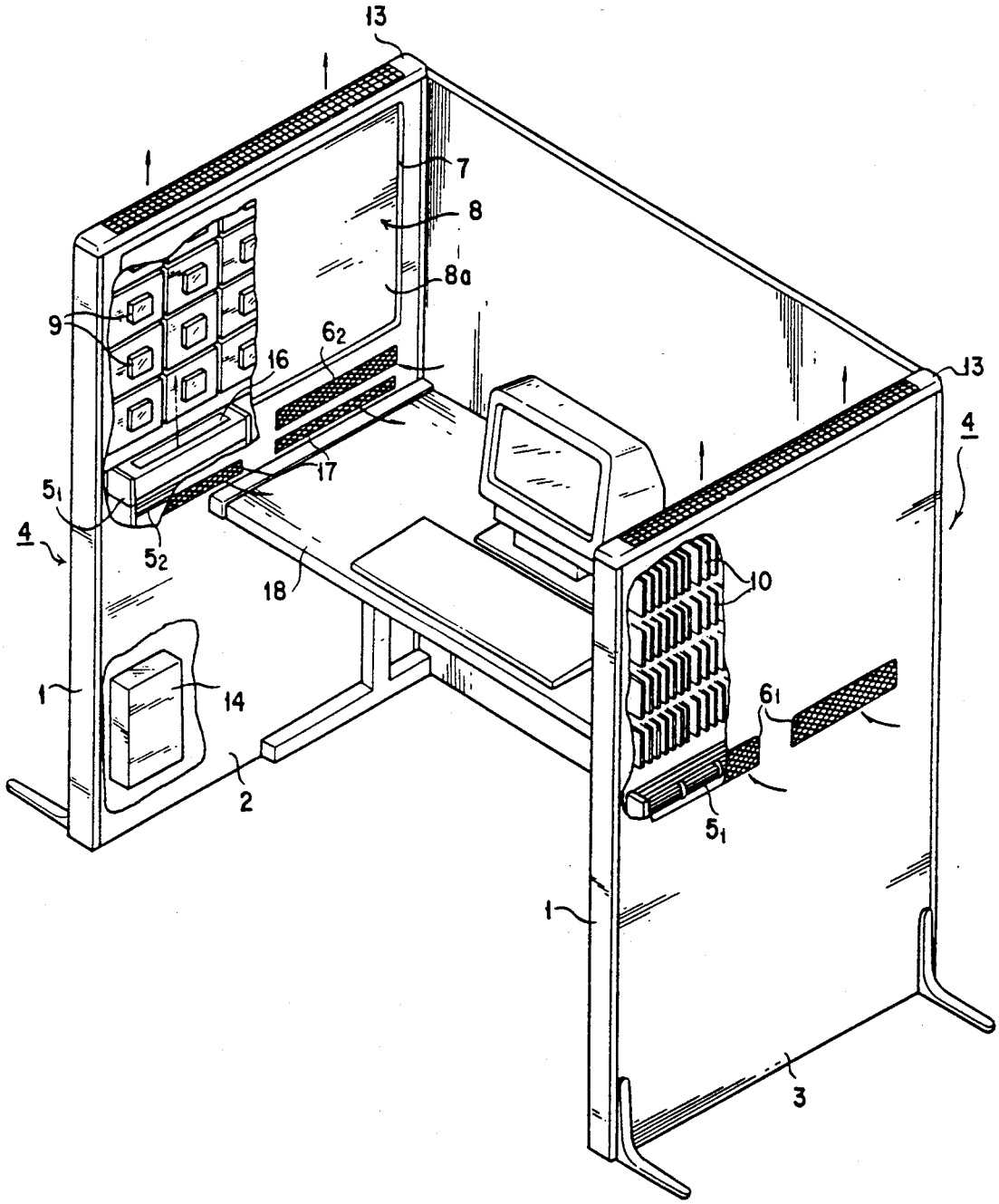
FIGS. 12 and 13 are a schematic, partially cut-away perspective view and a schematic, longitudinal sectional view, respectively, showing a further embodiment of the radiative panel type air-conditioning unit according to the present invention.
Figure 13:
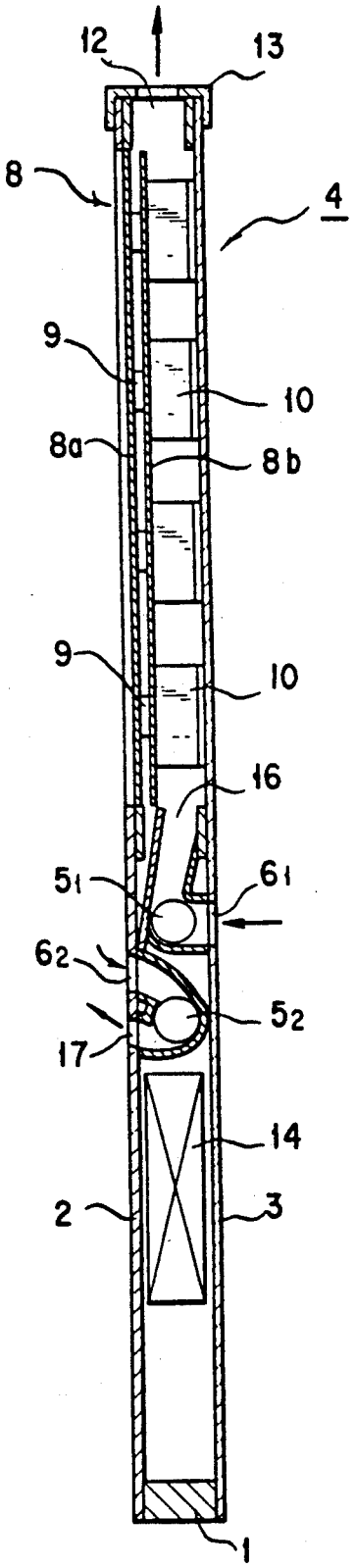

Further, in FIGS. 12 and 13, components designated by the same reference numerals as those used to indicate components of the second embodiment in FIGS. 6 to 8 have the same functions, and therefore the description of them is omitted to avoid duplication of the explanation thereof.

The characteristic feature of the third embodiment is as follows.

A first cross-fan $5_1$ and a second cross-flow fan $5_2$ are mounted below the above-mentioned radiation heat absorbing and emitting board 8 in a vertically spaced apart relationship with each other within the partitioning panel member 4. The above-mentioned second cross-flow fan $5_2$ is adapted to send out a gentle air.

The above-mentioned first cross-flow fan $5_1$ has air intakes 6 formed in a rear panel 3 of a partioning panel member 4, and an air blowoff port 16 directed upwardly in the partitioning panel member. Whilst, the second cross-flow fan $5_2$ has air intakes $6_2$ and air blowoff ports 17 formed in a front panel 2 at upper and lower positions, respectively in a vertically spaced apart relationship. The partitioning panel member 14 has a hot air outlet 12 formed in the uppermost end thereof. The arrangement is made such that the wind sent out by the first cross-flow fan $5_1$ through the blowoff ports 16 is allowed to pass through the radiating fins 10 of the radiation heat absorbing and emitting board 8 and exit from the hot air outlet 12. Reference numeral 14 denotes a controller installed in the lower part of the partitioning panel member 4. This controller 14 is adapted to control the switching on and off of the first and second cross-flow fans $5_1$ and $5_2$, the turning on and off of electricity to the thermoelectric elements 9, changing the direction of electric current flow through the thermoelectric elements 9, and the intensity of the electric current.

The above-mentioned partitioning panel member 4 is 60 to 80 mm thick and is of a size which is nearly the same as that of an ordinary low partition, and as occasion demands a plurality of such panel members may be used by placing them laterally in a row.

FIG. 12 shows an embodiment wherein the partitioning members 4 are used as low partitions surrounding a work table 18. The air intakes $6_2$ and the blowoff ports 17 of the second cross-flow fan $5_2$ are located above the work table 18.

In the above-mentioned arrangement, when the controller 14 is operated to feed electric current to the thermoelectric elements 9 so that heat is absorbed by the front side of the radiation heat absorbing and emitting board 8, and the heat thus absorbed is emitted through the rear side thereof by "Peltier Effect", and both the cross-flow fans $5_1$ and $5_2$ are driven, heat is absorbed by the front side of the radiation heat absorbing and emitting board 8 thereby cooling by radiation the front side of the partitioning panel member 4.

Whilst, at that time, the air behind the partitioning panel member 4 is drawn in by the first cross-flow fan $5_1$, which is then driven, through the air intakes $6_1$ and discharged from the blowoff ports 16 so that it may pass through a plurality of radiating fins 10 mounted on the radiation heat absorbing and emitting board 8 and exit from the hot air outlet 12. As a result, the heat emitted to the rear side of the radiation heat absorbing and emitting board 8 is transferred to the above-mentioned air flow, and is dissipated upwardly through the interior of the partitioning panel member 4.

Further, the air in front of the partitioning panel member 4 and just below the radiation heat absorbing and emitting board 8 is drawn in by the second cross-flow fan $5_2$, which is then driven, through the air intakes $6_2$ and is expelled downwardly through the blowoff ports 17. Thus, the air which is cooled by the front surface of the radiation heat absorbing and emitting board 8 and has descended is sucked in by the second cross-flow fan $5_2$ and is blown off by it onto the work table 18 as a gentle air.

Due to the above-mentioned air-conditioning effect, the worker sitting at the work table 18 is cooled by the radiant cooling effect caused by the radiation heat absorbing and emitting board 8, and by the cool air delivered by the second cross-flow fan $5_2$ as a gentle air. Further, the gentle air delivered by the second cross-flow fan $5_2$ should preferably have a flow belocity of about 0.3 $m/\rho$. The number of revolutions of the second cross-flow fan $5_2$ can be set as described by means of a switch at hand.

If the direction of electric current flow through the thermoelectric elements 9 is changed so that heat may be absorbed by the rear side of the radiation heat absorbing and emitting board 8 and the heat thus absorbed may be emitted by the front side thereof, then the front side of the partitioning panel member 4 is heated by radiation.

At that time, the wind delivered by the second cross-flow fan $5_2$ serves to circulate air. Further, in case of heating, the second cross-flow fan $5_2$ may be stopped.

Furthermore, whilst the above-mentioned embodiment shows a case where the blowoff port 17 for the second cross-fan $5_2$ is located above the work table 18, it is needless to say that hte blowoff port 17 may be located below the work table 18, and the aforementioned partitioning panel member 4 may be used as a partition board.

The foregoing description is merely illustrative of preferred embodiments of the present invention, and the scope of the present invention is not limited thereto. Many changes and modifications of the present invention will occur readily to those skilled in the art and may be implemented without departing from the scope of the present invention.

What is claimed is:

1. A radiative-panel-type air-conditioning unit, comprising:

a partitioning panel member; said partitioning panel member including a frame, a front panel, a rear panel, and a ventilation passage between said front and rear panels cross-flow fan means disposed inside said partitioning panel member in communication with said ventilation passage;

air intakes disposed in portions of said front panel adjacent to said cross-flow fan means;

an opening formed in an uppermost end of said partitioning panel member;

a window opening formed in an upper half of said partitioning panel member;

a radiation heat absorbing and emitting board having a first panel which includes a radiant heat transfer surface, a second panel having a plurality of heat exchange elements, and a plurality of thermoelectric elements disposed between said first and second panels; said radiation heat absorbing and emitting board being mounted in said window opening in such a manner that said plurality of heat exchange elements are located in said ventilation passage in communication with said cross-flow fan means; and controller means for controlling said thermoelectric elements of said radiation heat absorbing and emitting board and said cross-flow fan means.

2. A radiative-panel-type air-conditioning unit as claimed in claim 1, wherein said cross-flow fan means comprises first and second cross-flow fans which have a vertically aligned positional relationship with each other and said first cross-flow fan is located at an upper position and said second cross-flow fan is located at a lower position, and wherein said air intakes are first air intakes, and further comprising second air intakes formed in portions of said rear panel adjacent to said first cross-flow fan; first blowoff ports for said first cross-flow fan which open upwardly inside of said partitioning panel member; and second blowoff ports for said second cross-flow fan formed in said front panel opposite to said second cross-flow fan and at a position lower than said second air intakes.

3. A radiative-panel-type air-conditioning unit as claimed in claim 1, wherein said radiation heat absorbing and emitting board constitutes a first radiation heat absorbing and emitting board, and further comprising a second radiation heat absorbing and emitting board which is substantially identical to said first radiation heat absorbing and emitting board, and wherein said first and second radiation head absorbing and emitting boards are mounted on opposite sides of said partitioning panel member.

4. A radiative-panel-type air-conditioning unit as claimed in claim 1, wherein said partitioning panel member has a panel heater mounted on a lower portion thereof.

5. A radiative-panel-type air-conditioning unit as claimed in claim 1, wherein said radiant heat transfer surface is composed of a metallic radiation and sound absorbing material adhesively bonded onto one side of said first panel, and said plurality of thermoelectric elements are adhesively bonded onto the other side of said first panel; and a heat insulating and sound absorbing material filling a space between said first and second panels and said plurality of thermoelectric elements.

6. A radiative-panel-type air-conditioning unit as claimed in claim 5, wherein said radiation and sound absorbing material is composed of an alloy produced by sintering aluminium powder, and said heat insulating and sound absorbing material is glass wool.

7. A radiative-panel-type air-conditioning unit as comprising:

a first substrate having a first surface and a second surface;

a radiant heat transfer layer adjacent said first surface of said first substrate, said radiant heat transfer layer being a metallic radiation and sound absorbing material adhesively bonded to said first surface of said first substrate; said radiation and sound absorbing material being composed of an alloy produced by sintering aluminium powder;

a plurality of thermoelectric elements adhesively bonded to said second surface of said first substrate;

a second substrate having one surface adjacent said thermoelectric elements;

heat exchange means mounted on said second substrate; and a heat insulating and sound absorbing material substantially filling a space between said first and second substrates and said plurality of thermoelectric elements, and said heat insulating and sound absorbing material is glass wool.

* * * * *